United States Patent [19]

Herrick

[11] 3,953,763

[45] Apr. 27, 1976

[54] PULSED XENON ARC LAMP OPERATING CIRCUIT

[75] Inventor: Phillip R. Herrick, Fort Wayne, Ind.

[73] Assignee: General Electric Company, Indianapolis, Ind.

[22] Filed: Apr. 23, 1975

[21] Appl. No.: 570,689

[52] U.S. Cl. ..... 315/262; 315/DIG. 7; 315/100; 315/226; 315/241 S; 315/241 P; 315/243

[51] Int. Cl.[2] ..... H05B 41/34; H05B 41/29

[58] Field of Search ..... 315/241 S, 241 P, 262, 315/DIG. 7, 100 S, 243, 209, 226

[56] References Cited

UNITED STATES PATENTS

| | | | |
|---|---|---|---|
| 3,417,288 | 12/1968 | Cason | 315/241 P |
| 3,443,154 | 5/1969 | Hoekstra et al. | 315/241 R |
| 3,749,976 | 7/1973 | Colyn | 315/243 |

*Primary Examiner*—John Kominski

[57] ABSTRACT

A circuit for the repetitively pulsed operation of a xenon arc discharge lamp. A first SCR is responsive to a first control circuit when fired to allow the charging of a capacitor through a first inductor from a DC energy source. A second SCR is responsive to a second control circuit, and when fired connects the capacitor through a second inductor to a lamp to provide an operating current pulse for the lamp. Also, upon firing of the second SCR, the capacitor supplies a voltage pulse to a pulse transformer which in turn generates a high voltage pulse for ionizing the lamp. The first SCR is responsive to its control circuit to be conductive only when the capacitor is discharged and the second SCR is responsive to its respective control circuit to be conductive only when the capacitor is fully charged. In actual operation, one SCR must have been non-conducting for a predetermined time before the other SCR is allowed to become conductive thereby to prevent shoot-through.

29 Claims, 2 Drawing Figures

PULSED XENON ARC LAMP OPERATING CIRCUIT

BACKGROUND OF THE INVENTION

I. Field of the Invention

I. The present invention relates to a ballast circuit for an arc discharge lamp and more particularly, to a circuit for repetitive pulsed operation of a xenon arc discharge lamp.

II. Description of the Prior Art

A linear, xenon arc discharge lamp to be operated in a pulsed mode requires a power supply which provides a current to the lamp is brief pulses with a repetition rate sufficiently rapid to produce the appearance of continuous light. A synchronous supply producing 120 pulses per second is suitable for some applications whereas other applications require a faster rate.

Magnetic circuits have been used for the pulsed operation of xenon arc lamps. Such magnetic circuits, however, provide a substantial portion of the current at a low level between the pulses. The result of this is to produce relatively low luminous efficiency of the lamp. Present magnetic circuits are also confined to operate at line frequency or multiples thereof.

It is desirable therefore to provide a circuit capable of operating a linear xenon arc lamp in a pulsed mode. Accordingly, it is an object of the present invention to provide a circuit for pulsed operation of a linear xenon arc discharge lamp, preferably operable at a frequency of 240 Hz.

SUMMARY OF THE INVENTION

In accordance with the present invention there is provided a circuit for pulsed operation of an arc discharge lamp. First and second input terminals are provided for connection to a source of DC electrical energy and first and second output terminals are provided for connection to the lamp. First and second inductors are connected serially between the first input terminal and the first output terminal and first and second switches are connected serially between the second input terminal and second output terminal. Each switch has a conducting and a non-conducting state. A capacitor is included in circuit for providing operating current pulses to the lamp. High voltage generation means is connected in circuit for providing high voltage pulses for ionizing the lamp. The first switch is operative, when in the conducting state, to effectively connect the capacitor and the first inductor across the first and second input terminal for charging the capacitor. The second switch is operative, when in the conducting state, to effectively connect the second inductor and the capacitor across the output terminals and further to connect the high voltage generation means across the capacitor for energizing the high voltage generation means.

In the preferred embodiment, there is also included first control means for controlling turn-on of the first switch and second control means for controlling turn-on of the second switch.

DESCRIPTION OF THE PREFERRED EMBODIMENT

Figure 1:
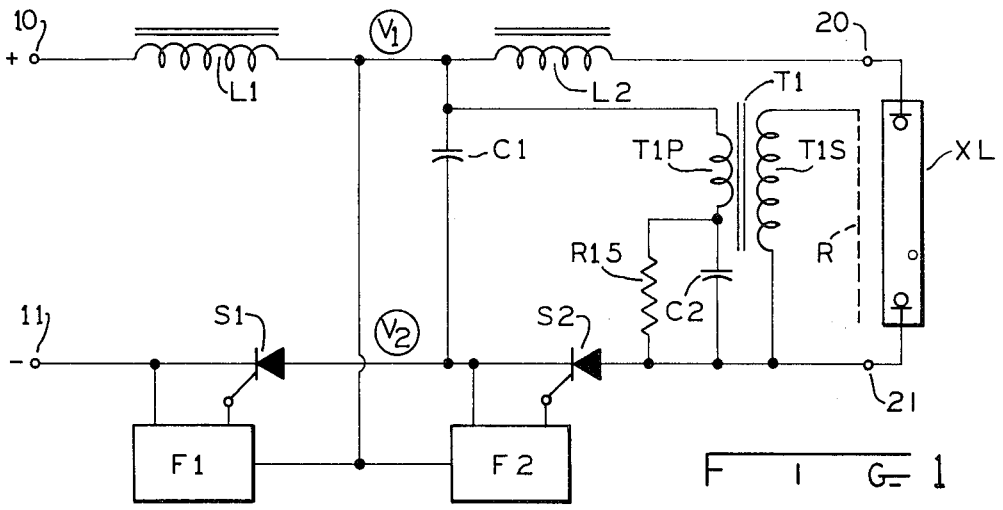
FIG. 1 is a basic schematic representation of the preferred embodiment of the circuit of the present invention.

In accordance with the present invention and referring now to FIG. 1, there is shown a circuit for repetitive pulsed operation of an arc discharge lamp such as xenon arc lamp XL. First and second input terminals 10 and 11 respectively are provided for connection to a source of DC electrical energy capable of providing 300VDC with terminal 10 being denoted positive and terminal 11 denoted negative. First and second output terminals 20 and 21 respectively are provided for connection to the lamp XL. A first inductor L1 and a second inductor L2 are connected serially between input terminal 10 and output terminal 20. First and second switches in the form of first SCR S1 and second SCR S2 respectively are connected in circuit serially between input terminal 11 and output terminal 21. An AC capacitor C1 is connected between the junction of L1 and L2 and the junction of SCR S1 and SCR S2. High voltage (HV) generation means includes a pulse transformer T1 having a primary winding T1P and a secondary winding T1S magnetically coupled thereto. One terminal of secondary winding T1S is electrically connected to a trigger electrode, reflector R for providing a high voltage ionizing pulse to the lamp by capacitive coupling to aid in its starting. First control means F1 is provided for controlling turn-on of first SCR S1 and second control means F2 is provided for controlling turn-on of second SCR S2.

First inductor L1, capacitor C1 and first SCR S1 form a charging circuit. When SCR S1 is turned on, capacitor C1 charges through inductor L1 by resonance to nearly twice the applied DC voltage at terminals 10 and 11 whereupon the current begins to reverse and SCR S1 turns off, leaving capacitor C1 charged.

Inductor L2, lamp XL and second SCR S2 form a discharge circuit. SCR S2 is turned on at an appropriate interval after SCR S1 has turned off. Capacitor C1 discharges through the inductor L2 and the lamp XL. Resonance reverses the capacitor voltage and SCR S2 then turns off.

Figure 2:
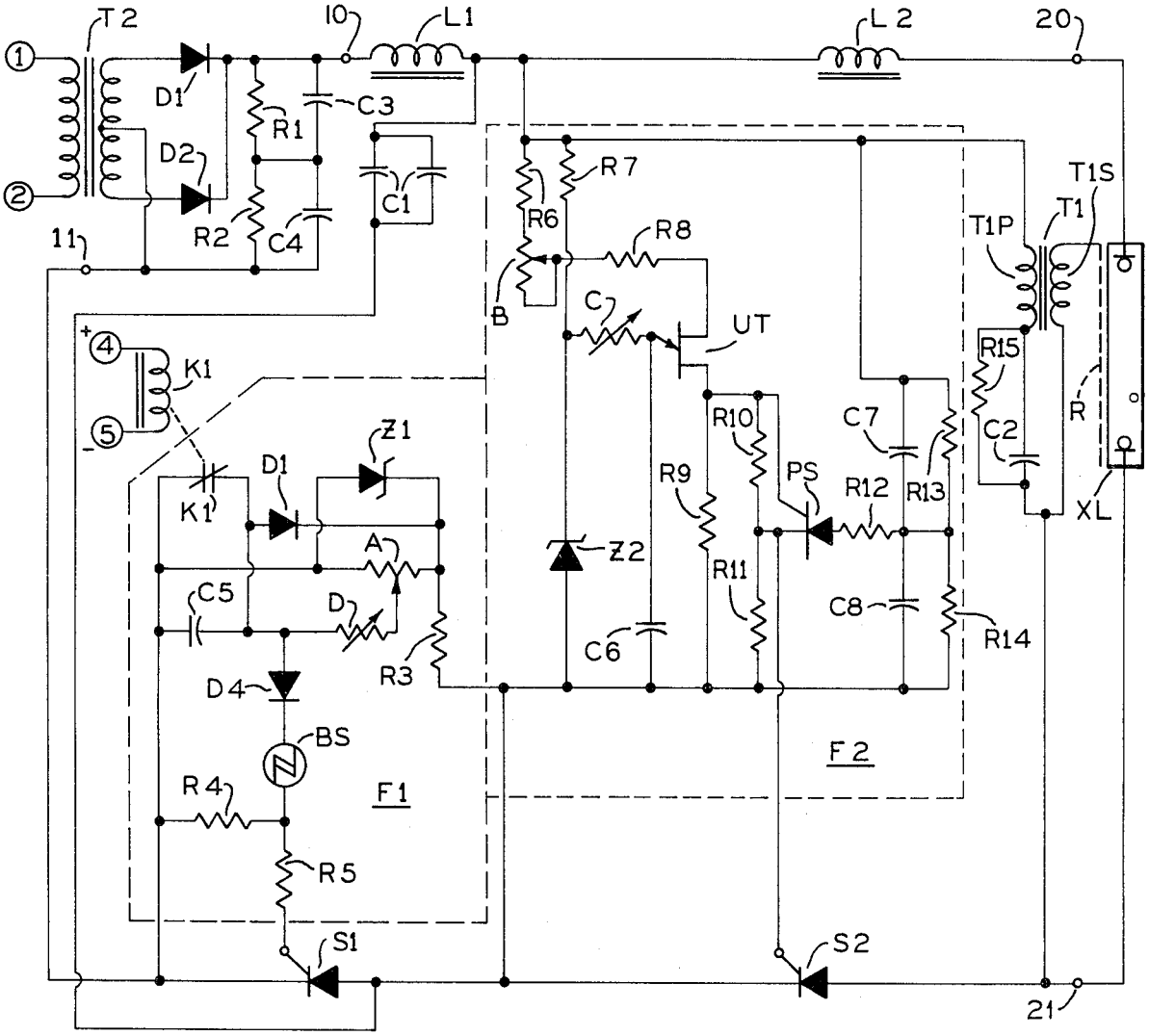
FIG. 2 is a more detailed schematic representation of the preferred embodiment of the circuit for pulsed operation of a xenon arc discharge lamp of the present invention.

Referring now to FIG. 2, there is shown by detailed schematic representation, the preferred embodiment of the present invention. Terminals 1 and 2 are arranged for connection to a source of AC line voltage of nominal 208 volts 60 Hz. Terminals 1 and 2 are then connected to the primary winding of an isolation transformer T2, the secondary winding of which is connected to circuit input terminals 10 and 11. Rectification and filtering are provided by appropriate means.

The first control means F1 includes means for preventing turn-on of the first SCR S1 until the applied DC voltage reaches a predetermined value, that is, a value sufficient to start the lamp XL. To this end, there is provided a voltage divider consisting of resistor R3 and variable resistor A. Also included is a reed-relay K1 which turns the lamp XL on and off by preventing the firing of inpput SCR S1. The coil of this relay is provided with terminals 4 and 5 which are in turn connected to a 12VDC source. The coil of K1 must energized in this embodiment with 12 volts with the proper polarity for the lamp to turn on. First control F1 also includes means for producing a predetermined delay in the firing of the SCR S1 and includes variable resistor D. Also included in F1 is means for clamping the voltage supplied to the first control means F1 such that the turn-on rate or frequency of firing of first SCR S1 during circuit operation may be independent of varying input voltage as, for example, the AC line voltage supplied to input terminals 1 and 2. This includes a zener diode Z1.

Second control means F1 includes means for producing a predetermined delay in the turn-on or firing of the second SCR S2. This includes a variable resistor C. Also included in the second control means are means for varying the delay in the turn-on or firing of the second SCR S2 for reducing the frequency of light pulses in proportion to input voltage increase to maintain relatively constant light output. That is, means are provided for varying the delay in the firing of the second SCR S2 in inverse proportion to input DC source voltage at terminals 10 and 11 so as to maintain a relatively constant light output, this being accomplished by the connection of the base of unijunction transistor UT to a voltage proportional to the voltage on capacitor C1 through resistor R8 and variable resistor B. Means are also provided in second control circuit F2 for maintaining the second switch SCR S2 in the conduction state; that is, for maintaining gate drive on second SCR S2 for sufficient duration that current may build up therein to effect latching. This includes a pilot SCR PS. This is necessary since, because of the characteristics of discharge lamp XL, current build up is delayed.

It will be noted that the turn-on of first SCR S1 and second SCR S2 must be synchronized at the desired frequency so that they alternate in operation, this is in conducting, with a sufficient time between turn-on so that one switch has time to thoroughly turn off before the other switch turns on. Otherwise, they will be both on or conducting at the same time with a very high current through the lamp resulting. The synchronization is accomplished since first control F1 is actuated only when a positive voltage exists from point V2 to minut input terminal 11 and, second control F2 is activated only when the voltage is positive from V1 and V2. Thus, first control F1 will operate only when the capacitor C1 is discharged and second control F2 will operate only when it is charged.

Operation of the circuit will now be discussed.

Xenon arc discharge lamp XL is operated by the discharge of a capacitor C1 through an SCR S2 with the simultaneous production of a high voltage pulse applied to the lamp reflector R. Of course, it is within the contemplation of this invention that such a HV pulse may be applied to the lamp by direct coupling as well as by capacitive coupling. The lamp LX is ballasted by means of capacitor C1 being alternately charged and discharged by SCRs S1 and S2. Capacitor C1 is in reality two capacitors connected in parallel to form a total of 30 microfarads. The first SCR S1 fires and charges the 30 microfarad capacitor C1 through one of the reactors L1. After SCR S1 is extinguished, the second SCR S2 fires and discharges the capacitor C1 through the lamp XL and the second reactor L2. When the second SCR S2 fires, pulse transformer T1 produces a 4 Kv pulse which is applied to the reflector R or other member adjacent the lamp for capacitive coupling thereto. The two SCRs fire sequentially in this manner producing current pulses to the lamp at a rate of 260 pulses per second at nominal voltage input. The firing circuit F2 for the second SCR S2 reduces this rate if the supply voltage increases. This reduces the wattage variances in the lamp with varying input voltage. With a plus or minus 10% swing in input voltage at input terminals 10 and 11, lamp wattage varies from minus 18% to plus 8% and frequency swings from 290 Hz to 210 Hz. As compared with a typical magnetic pulsed power supply, this power supply produces a 50% increase in luminous efficiency of lamp XL.

As stated above, charging SCR S1 is controlled by a control circuit F1 which prevents the firing of the SCR unit the applied voltage at terminals 10 and 11 has reached a certain minimum value sufficient to start the lamp. Once the lamp is started into operation, the voltage across this SCR S1 rises considerably. Now a zener diode Z1 clamps the control circuit voltage so that the firing rate during operation is independent of line voltage. The control circuit F2 for the firing of the discharge SCR S2 is designed so that the frequency varies inversely with the line voltage. Higher line voltage would tend to produce higher wattage in the lamp. This feature of the circuit regulates in such a way so as to reduce the variation of lamp wattage with line voltage.

Furthermore, the firing capacitor C5 in the charging SCR control circuit F1 is shorted by a normally closed reed-relay K1. So long as the reed-relay K1 remains closed, the charging SCR S1 will not fire and the lamp will not operate. This permits the lamp XL to be controlled by a low power signal operating the coil of the relay K1.

When the lamp XL has been ionized by the high voltage pulse following the firing of the discharge of SCR S1, it remains at a relatively high resistance. Current does not increase fast enough to hold SCR S2 in conduction. To overcome this problem, pilot SCR S2 is used to maintain gate drive for SCR S2 long enough to allow current to build up to the sustaining or latching point. Current is provided by two capacitors C7 and C8 which are designed so that the gate current returns to zero before the SCR is again called upon to stand off voltage.

Four adjustment controls A, B, C and D have been provided and their operation will be now described.

Control A is a 10K potentiometer which determines the input voltage necessary to commence operation. It assures that sufficient voltage for lamp starting is available before the SCRs commence firing. This control is adjusted by first setting the supply voltage to a low value and then gradually increasing it to the desired minimum operating voltage. If the voltage is run above this value, it will be necessary to wait a minute or two until the power supply is discharged to the desired value. When the DC power supply is stabilized, gradually turn control A until the lamp XL starts. Control A can not be set correctly with the lamp running. If the reed-relay K1 is always used to start the lamp, the adjustment of control A is not critical.

Control B determines the wattage regulating characteristics of the circuit. By adjusting this potentiometer, the amount of regulation and frequency swing are varied. Both controls A and B have an effect upon the frequency if they are adjusted. It will be necessary to make corresponding adjustments on control D and C to restore the frequency to the correct value.

Control D controls the firing rate of the input SCR S1.

Control C controls the firing rate of the output or discharge SCR S2.

If these controls are used to increase frequency, they must not be adjusted beyond the point where one SCR fires earlier than 200 microseconds after the other SCR current has gone to zero. Otherwise, the other SCR may not remain extinguished and both SCRs will come into conduction simultaneously resulting in a condition called shoot-through with a current of about 150 amperes. A circuit breaker normally supplied at the input of the DC power supply will open to prevent destruction of the power supply. It will normally be necessary to back off the frequency and reset the circuit breaker.

Careful adjustment of the controls D and C will make it possible to produce a balanced increase in firing rate of the two SCRs. Frequencies up to 400 Hz can be obtained. However, under these conditions, the lamp and inductors will be severely overloaded. This may be overcome by replacing the 30 micorfarad capacitor C1 with one of suitable lower value.

If constant frequency for all input voltages is desired, a change in wiring is necessary. It is only necessary to disconnect the connection of resistor R8 with control B thence to make the connection of resistor R8 with the junction of zener Z2 and control C. This will power resistor R8 and unijunction UT from the zener voltage which is constant. Control C should then be adjusted with the lamp disconnected so as to give the same firing frequency as before the change was made. The best method to accomplish this is to adjust for a unijunction UT emitter firing voltage of about 10 to 12 volts.

The circuit of FIG. 2 has been built and operated satisfactorily with components having the following values:

| | |
|---|---|
| Control A | 10K ohm |
| Control B | 250K ohm |
| Control C | 50K ohm |
| Control D | 100K ohm |
| SCRs S1, S2 | C30D |
| SCR PS | C106D |
| Unijunction Transistor UT | 1500W |
| Diodes D1, D2 | 1N3766 |
| Diodes D3, D4 | 1N5059 |
| Bilateral Switch BS | 2N4992 |
| Zener Diode Z1 | 1N4749, 24V |
| Zener Diode Z2 | Z4XL163, 15V |
| Capacitor C1 | (2) 15,uF, 330V in parallel |
| Capacitor C2 | .02,uF, 100V |
| Capacitors C3, C4 | 4200,uF, 250V |
| Capacitors C5, C6 | .1,uF, 20V |
| Capacitors C7, C8 | .0033,uF, 600V |
| Resistors R1, R2 | .1 megohm |
| Resistors R3, R6 | 68K ohm, 2W |
| Resistor R4 | 1000 ohm |
| Resistor R5 | 22 ohm |
| Resistor R7 | 47K ohm, 2W |
| Resistor R8 | 1K ohm |
| Resistor R9 | 47 ohm |
| Resistors R10, R11 | 100 ohm |
| Resistor R12 | 3.3K ohm |
| Resistors R13, R14, R15 | 100K ohm |
| PXA Lamp XL | GE, 1500W |
| Inductor L1 | 1.75mh. |
| Inductor L2 | .75mh. |

It should be apparent to those skilled in the art that the embodiment described theretofore is considered to be the presently preferred form of the invention. In accordance with the Patent Statutes, changes may be made in the disclosed apparatus and the manner in which it is used without actually departing from the true spirit and scope of this invention.

What I claim is new and desire to be secure by Letters Patent in the United States is:

1. A circuit for pulsed operation of an arc discharge lamp, comprising:

first and second input terminals for connection to a source of DC electrical energy;

first and second output terminals for connection to the lamp;

first and second inductors connected serially between the first input terminal and the first output terminal;

first and second switches connected serially between the second input terminal and the second output terminal, each switch having a conducting and a non-conducting state;

a capacitor for providing operating current pulses to the lamp;

high voltage generation means connected in circuit for providing high voltage pulses for ionizing the lamp;

the first switch being operative when in the conducting state to effectively connect the capacitor and the first inductor across the first and second input terminals for charging the capacitor, the second switch being operative when in the conducting state to effectively connect the second inductor and the capacitor acrross the output terminals and to connect the high voltage generation means across the capacitor for energizing the high voltage generation means.

2. The circuit of claim 1 further comprising:

first control means for controlling turn-on of the first switch and second control means for controlling turn-on of the second switch.

3. The circuit of claim 2 wherein the first control means comprises:

means for preventing turn-on of the first switch until the DC input source voltage reaches a predetermined value;

means for producing a predetermined delay in the turn-on of the first switch; and means for clamping the voltage supplied the first control means that the frequency of turn-on of the first switch during circuit operation may be independent of varying DC input source voltage.

4. The circuit of claim 2 wherein the second control means comprises:

means for producing a predetermined delay in the turn-on of the second switch;

means for varying the delay in turn-on of the second switch for reducing the frequency of light pulses in proportion to DC input source voltage increase for maintaining relatively constant light output; and means for maintaining the second switch in the conducting state for sufficient time duration that current may build up therein to a sustaining value.

5. The circuit of claim 2 wherein the first control means is actuated when a positive voltage with respect to the second input terminal appears at the junction of the first and second switches, and the second control means is actuated when a positive voltage with respect to the junction of the first and second switches appears at the junction of the first and second inductors.

6. The circuit of claim 1 wherein the high voltage generation means includes a pulse transformer having a primary winding arranged in circuit to receive a current pulse from the capacitor upon turn-on of the second switch, and further includes a secondary winding magentically coupled to the primary winding, the secondary winding providing the high voltage pulse for ionizing the lamp.

7. The circuit of claim 6 wherein the secondary winding is electrically connected to a trigger electrode mounted for capacitive coupling to the lamp.

8. A circuit for repetitive pulsed operation of an arc discharge lamp, comprising:

first and second input terminals for connection to a DC electrical energy source;

first and second input terminals for connection to the lamp;

first and second semiconductor switches connected serially between the second input terminal and the second output terminal, each switch having a conducting and a non-conducting state, the swithces arranged for alternate conduction;

first and second inductors connected serially between the first input terminal and the first output terminal, the first inductor aiding in the turn-off of the first switch and the second inductor aiding in the turn-off of the second switch;

high voltage (HV) generation means connected in circuit for providing HV pulses for ionizing the lamp;

a capacitor connected in circuit to be charged from the DC energy source through the first inductor upon turn-on of the first switch, and upon turn-on of the second switch to become discharged through the second inductor to provide an operating current pulse for the lamp and further, upon conduction of the second switch to energize the HV generation means.

9. The circuit of claim 8 wherein the HV generation means is capacitively coupled to the lamp.

10. The circuit of claim 8 wherein the HV generation means is directly coupled to the lamp.

11. The circuit of claim 8 further comprising:

first control means for controlling turn-on of the first switch and second control means for controlling turn-on of the second switch.

12. The circuit of claim 11 wherein the first control means turns-off the first seitch and the second control means further turns-off the second switch.

13. The circuit of claim 11 wherein the first control means for controlling the first switch comprises:

means for preventing turn-on of the first switch until the input DC source voltage reaches a predetermined value;

means for producing a predetermined delay in the turn-on of the first switch; and means for clamping the voltage supplied the first control means that the turn-on rate of the first switch during operation be independent of varying input DC source voltage.

14. The circuit of claim 11 wherein the second control means for controlling the second switch, comprises:

means for producing a predetermined delay in the turn-on of the second switch;

means for varying the delay in the turn-on of the second switch for reducing the frequency of light pulses in proportion to input voltage increase to maintain relatively constant light output; and means for maintaining the second switch in the turn-on state for sufficient time duration that current may build up therein to a sustaining value.

15. The circuit of claim 8 wherein the capacitor is charged, by resonance, to a value approximately twice the input DC source voltage.

16. The circuit of claim 8 wherein, upon discharge of the capacitor through the second inductor, resonance reverses the capacitor voltage to effect turn-off of the second switch.

17. The circuit of claim 8 wherein the HV generation means includes a pulse transformer having a primary winding arranged in circuit to receive a current pulse from the capacitor upon turn-on of the second switch, and further includes a secondary winding magnetically coupled to the primary winding, the secondary winding providing the HV ionizing pulse for starting the lamp.

18. The circuit of claim 17 wherein the secondary winding is electrically connected to a trigger electrode mounted in close proximity to the lamp for capacitive coupling thereto.

19. The circuit of claim 11 wherein the first control means is actuated when a positive voltage, with respect to the second input terminal, appears at the junction of the first and second switches, and the second control means is actuated when a positive voltage, with respect to the junction of the first and second switches, appears at the junction of the first and second inductors.

20. The circuit of claim 13 wherein the means for preventing includes a normally-closed reed-relay in parallel with a turn-on capacitor, the reed-relay being operable in response to the application of a predetermined DC voltage to a coil associated therewith to open the relay contacts.

21. A circuit for operating a pulsed xenon arc discharge lamp, comprising:

a first input terminal for connection to the positive side of a DC electrical energy source and a second input terminal for connection to the negative side of the DC source;

first and second output terminals for connection to the lamp;

first and second inductors connected in circuit serially between the first input terminal and the first ouotput terminal;

a first SCR connected to the second input terminal, and a second SCR connected serially in circuit between the first SCR and the second output terminal, the SCRs arranged to be fired alternately;

a capacitor connected in circuit between the junction of the first and second inductors and the junction of the first and second SCRs, the capacitor to be charged from the DC source through the first inductor when the first SCR fires and to become discharged through the second inductor to provide operating voltage for the lamp when the second SCR fires;

a pulse transformer having a primary winding arranged in a circuit to receive a current pulse from the capacitor when the second SCR fires, the transformer further having a secondary winding magnetically coupled to the primary winding for producing a high voltage pulse for ionizing the lamp upon each firing of the second SCR;

first control means for controlling the firing of the first SCR; and second control means for controlling the firing of the second SCR.

22. The circuit of claim 21 wherein the first control means comprises:

means for preventing firing of the first SCR until the input DC source voltage reaches a value sufficient to start the lamp;

means for producing a predetermined delay in the firing of the first SCR; and means for clamping the voltage in the first control means that the firing frequency of the first SCR be independent of varying input DC source voltage.

23. The circuit of claim 22 wherein the means for clamping includes a zener diode.

24. The circuit of claim 22 wherein the means for preventing includes a normally-closed reed-relay connected in circuit in parallel with a firing capacitor, the reed-relay including a coil connected across the first and second input terminals, the reed-relay being operable in response to a predetermined DC voltage to open the relay contacts.

25. The circuit of claim 21 wherein the second control means comprises:

means for producing a predetermined delay in the firing of the second SCR;

means for varying the delay in firing of the second SCR in inverse proportion to input DC source voltagge for maintaining relatively constant light output; and means for maintaining gate drive on the second SCR for sufficient time duration that current may build up therein to effect latching thereof.

26. The circuit of claim 25 wherein the means for maintaining includes a pilot SCR connected in the second SCR gate circuit.

27. The circuit of claim 21 wherein the capacitor is charged, by resonance, to a voltage level approximately twice the applied input DC source voltage.

28. The circuit of claim 21 wherein, upon discharge of the capacitor through the second inductor resonance effects reversal of the capacitor voltage to turn-off the second SCR.

29. The circuit of claim 21 wherein the pulse transformer secondary winding is connected to a trigger electrode mounted in close proximity to the lamp for capacitive coupling thereto.

* * * * *

UNITED STATES PATENT OFFICE

CERTIFICATE OF CORRECTION

Patent No. 3,953,763 Dated April 27, 1976

Inventor(s) Phillip R. Herrick

It is certified that error appears in the above-identified patent and that said Letters Patent are hereby corrected as shown below:

Column 5, line 39, "1500W" should read --2N2646--;

Column 7, line 8, "input" should read --output--;

Column 8, line 54, first occurrence, "a" should be omitted.

Signed and Sealed this

Tenth Day of August 1976

[SEAL]

*Attest:*

RUTH C. MASON
*Attesting Officer*

C. MARSHALL DANN
*Commissioner of Patents and Trademarks*